US010105578B2

(12) United States Patent
Quan et al.

(10) Patent No.: US 10,105,578 B2
(45) **Date of Patent: *Oct. 23, 2018**

(54) GOLF CLUB HEADS WITH PROTECTIVE LAYER AND METHODS OF MANUFACTURING THE GOLF CLUB HEADS

(71) Applicant: Karsten Manufacturing Corporation, Phoenix, AZ (US)

(72) Inventors: Liang Quan, San Jose, CA (US); Anthony D. Serrano, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/648,371

(22) Filed: Jul. 12, 2017

(65) Prior Publication Data

US 2017/0304686 A1 Oct. 26, 2017

Related U.S. Application Data

(63) Continuation of application No. 15/073,166, filed on Mar. 17, 2016, now Pat. No. 9,757,626, which is a (Continued)

(51) Int. Cl.
*A63B 53/04* (2015.01)
*A63B 53/00* (2015.01)
(Continued)

(52) U.S. Cl.
CPC ..... *A63B 53/007* (2013.01); *A63B 53/04* (2013.01); *A63B 53/0487* (2013.01); (Continued)

(58) Field of Classification Search
CPC ... A63B 53/0487; A63B 53/04; A63B 53/007; A63B 2053/042; A63B 2053/0425; (Continued)

(56) References Cited

U.S. PATENT DOCUMENTS 2,893,864 A 7/1959 Harris et al.
3,975,023 A 8/1976 Inamori
(Continued)

OTHER PUBLICATIONS

WayBack Machine, Wikipedia, "Aluminum Oxide", Jan. 18, 2010.
WayBack Machine, Wikipedia, "Plasma Electrolytic Oxidation", Jan. 31, 2010.

*Primary Examiner* — Benjamin Layno

(57) ABSTRACT

Embodiments of golf club heads and methods to manufacture such a golf club heads are generally described herein. In some embodiments, the golf club head may include a ball-striking face and a protective aluminum oxide layer coupled to the ball-striking face of the golf club head. The protective aluminum oxide layer is associated with a hardness that is greater than that of the ball-striking face. In further embodiments, golf club heads may include a top portion and at least one of a plurality of interchangeable alignment indicia coupled thereto, which are configured to guide the golf club head relative to a golf ball.

20 Claims, 8 Drawing Sheets

Related U.S. Application Data continuation of application No. 14/464,881, filed on Aug. 21, 2014, now Pat. No. 9,314,678, which is a continuation-in-part of application No. 13/672,344, filed on Nov. 8, 2012.

(51) Int. Cl.
*C25D 11/24* (2006.01)
*C25D 11/08* (2006.01)

(52) U.S. Cl.
CPC ..... *C25D 11/08* (2013.01); *C25D 11/24* (2013.01); *A63B 2053/042* (2013.01); *A63B 2053/0408* (2013.01); *A63B 2053/0425* (2013.01); *A63B 2053/0429* (2013.01); *A63B 2053/0437* (2013.01); *A63B 2053/0441* (2013.01); *A63B 2209/00* (2013.01)

(58) Field of Classification Search
CPC .... A63B 2053/0429; A63B 2053/0437; A63B 2053/0441; A63B 2209/00
USPC ..... 473/329, 342, 340, 349, 242, 231
See application file for complete search history.

(56) References Cited

U.S. PATENT DOCUMENTS

| | | | | |
|---|---|---|---|---|
| 4,326,716 | A | 4/1982 | LaCoste | |
| 5,489,098 | A | 2/1996 | Gojny et al. | |
| 6,010,411 | A | 1/2000 | Reyes | |
| 6,623,376 | B2 | 9/2003 | Poynor | |
| 6,878,074 | B2 | 4/2005 | Bryne et al. | |
| 6,986,193 | B2 | 1/2006 | Bryne et al. | |
| 7,063,628 | B2 | 6/2006 | Reyes et al. | |
| 7,438,647 | B1 | 10/2008 | Hocknell | |
| 7,491,136 | B2 | 2/2009 | Deng et al. | |
| 7,717,807 | B2 | 5/2010 | Evans et al. | |
| 7,762,908 | B2 | 7/2010 | Perkins | |
| 7,854,364 | B2 | 12/2010 | DeShiell et al. | |
| 7,874,936 | B2 | 1/2011 | Chao | |
| 8,075,420 | B2 | 12/2011 | Rick | |
| 9,314,678 | B2 | 4/2016 | Quan et al. | |
| 9,757,626 | B2 * | 9/2017 | Quan ..... | A63B 53/007 |
| 2005/0187028 | A1 | 8/2005 | Chang et al. | |
| 2005/0246884 | A1 | 11/2005 | Chen et al. | |
| 2007/0004535 | A1 | 1/2007 | Hsu | |
| 2007/0270235 | A1 | 11/2007 | Chu Yuk Man | |
| 2010/0184527 | A1 | 7/2010 | Demkowshi et al. | |
| 2013/0065706 | A1 | 3/2013 | Park | |

* cited by examiner

GOLF CLUB HEADS WITH PROTECTIVE LAYER AND METHODS OF MANUFACTURING THE GOLF CLUB HEADS

CROSS-REFERENCE TO RELATED APPLICATIONS

This is a continuation of U.S. Non-Provisional application Ser. No. 15/073,166 filed on Mar. 17, 2016, now U.S. Pat. No. 9,757,626, which is a continuation of U.S. Non-Provisional application Ser. No. 14/464,881, filed on Aug. 21, 2014, now U.S. Pat. No. 9,314,678, which issued on Apr. 19, 2016, which is a continuation in part of U.S. Non-Provisional application Ser. No. 13/672,344, filed on Nov. 8, 2012, now abandoned, the entire contents of which are fully incorporated herein.

FIELD

The present disclosure relates to a club head having a ball-striking face, and in particular a golf club head.

BACKGROUND

In several types of sports, such as golf, hockey, baseball, softball, tee ball, and cricket, an individual may use a club with a ball-striking face to strike an object such as a ball. For each sport, a variety of clubs may be used. In particular, golf clubs may include a driver-type golf club, a fairway wood-type golf club, a hybrid-type golf club, an iron-type golf club, a wedge-type golf club, and a putter-type golf club. During use or in transporting, one or more golf club heads may become worn and potentially dented or scraped. For example, a golf club such as a putter may be rattled against other clubs in a golf bag during transporting, and the golf club head may become undesirably scratched and/or dented. A golf club head with a high hardness may suitably resist wear and denting.

Alignment features may be included on a golf club head, particularly in a putter-type golf club, so as to potentially improve alignment relative to a golf ball and thereby enhance the performance of an individual. For instance, proper alignment between the golf club head and the golf ball may result in better and consistent control over the distance, direction, spin, and/or speed of the golf ball. Conversely, an off-center impact may result between the golf club head and the golf ball. To avoid an off-center impact, the individual may direct his or her vision over the golf club head to improve alignment between the golf club head and the golf ball. To ease and improve the individual's visual alignment or boost the individual's confidence, various alignment features may be included on the golf club head.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

As described herein, golf club heads in some embodiments are configured to comprise a protective ceramic layer. For example, a golf club head as described herein may include at least one ball-striking face, and a protective aluminum oxide layer coupled to the ball-striking face. The protective aluminum oxide layer is associated with a hardness that is greater than that of the ball-striking face, which may reduce a thickness of the ball-striking face compared to other golf club heads. The reduced thickness of the ball-striking face may reduce the weight of the golf club head so that discretionary weight may be suitably placed elsewhere for enhancing the performance of the golf club. For example, a center of gravity may be advantageously moved away from the ball-striking face and lowered toward a bottom of the golf club head, thereby improving balance, stability, or both of the golf club head. In further embodiments, golf club heads may include a top portion and at least one of a plurality of interchangeable alignment indicia coupled thereto, which are configured to guide the golf club head relative to a golf ball. The interchangeable alignment indicia can allow an individual, a manufacturer, or both, to choose from a variety of options to potentially improve alignment relative to a golf ball.

Figure 1:
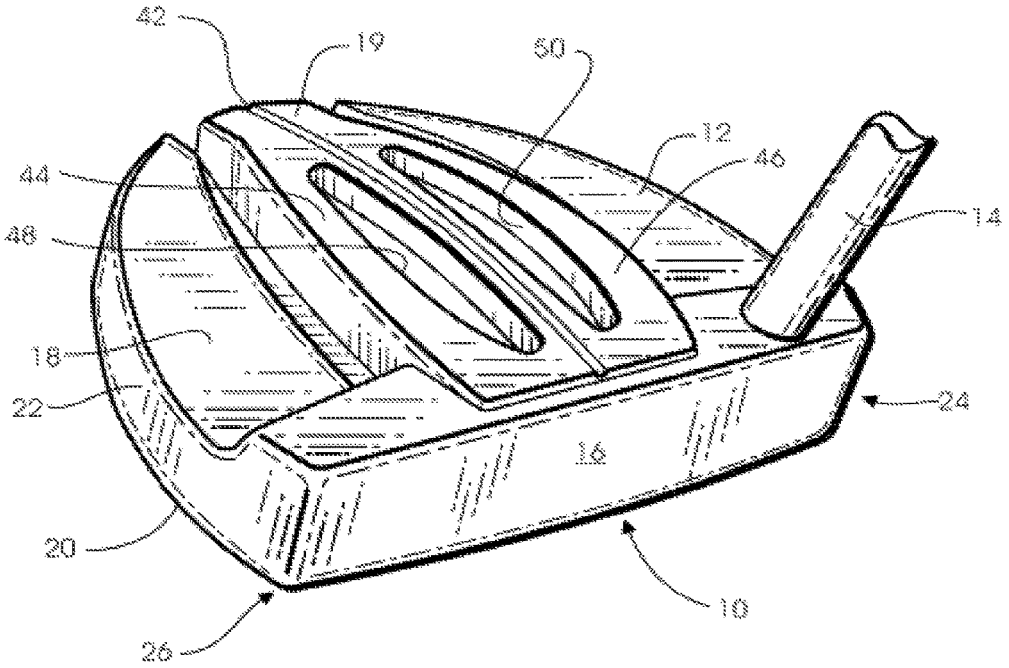
FIG. 1 is a perspective view of a golf club head according to one embodiment of the apparatus, methods, and articles of manufacture described herein, the golf club head including a ball-striking face.

Referring to FIG. 1, for example, a golf club 10 comprises a golf club head 12 and a shaft 14 coupled thereto. The golf club head 12 includes a ball-striking face 16 configured and adapted for impacting a golf ball (not shown). The illustrated golf club head 12 is a putter-type golf club head, comprising a top portion 18 and a bottom portion or underside 20. As used herein, the terms "top," "bottom," "front," "rear," "side," and other directional terms are not intended to require any particular orientation, but are instead used for purposes of description only. The top and bottom portions 18, 20 are spaced apart from each other, with the ball-striking face 16 and a perimeter surface 22 extending therebetween. The illustrated top portion 18 is coupled to one of a plurality of interchangeable alignment indicia 19, as explained below. The illustrated golf club head 12 also has a heel 24 on an end proximal to the shaft 14 and a toe 26 on an end distal to the shaft 14.

Although FIG. 1 illustrates the golf club 10 as a mallet-type putter, the golf club 10 may be a blade-type putter or any other types of putters. In still other embodiments, the golf club 10 can be any other types of golf clubs. For example, in some embodiments, the golf club 10 can be a driver-type golf club, a fairway wood-type golf club, an iron-type golf club, or a hybrid-type golf club, or a wedge-type golf club. The apparatus, methods, and articles of manufacture described herein are not limited in this regard.

In some embodiments, the ball-striking face 16 may comprise at least one of an aluminum alloy, a stainless steel, a carbon steel, a titanium alloy, a copper alloy, a nickel alloy, a magnesium alloy, an amorphous alloy, a composite material, or any combination thereof. Aluminum alloys may be commonly grouped according to their chemical compositions into the following alloy designation series: a 1000 series aluminum alloy, a 2000 series aluminum alloy, a 3000 series aluminum alloy, a 4000 series aluminum alloy, a 5000 series aluminum alloy, a 6000 series aluminum alloy, and a 7000 series aluminum alloy. A 1000 series aluminum alloy may contain aluminum of 99.00% or higher purity. A 2000 series aluminum alloy may contain copper as the principal alloying element, often with magnesium as a secondary addition. A 3000 series aluminum alloy may contain manganese as the major alloying element. A 4000 series aluminum alloy may contain silicon as the major alloying element. A 5000 series aluminum alloy may contain magnesium as the major alloying element. A 6000 series aluminum alloy may contain silicon and magnesium. A 7000 series aluminum alloy may contain zinc as the major alloying element. In other embodiments, the ball-striking face 16 may be made from other materials. The apparatus, methods, and articles of manufacture described herein are not limited in this regard.

In some embodiments, the ball-striking face 16 may comprise, by weight, about 0.8% to about 1.2% magnesium, about 0.4% to about 0.8% silicon, about 0.15% to about 0.40% copper, about 0.04% to about 0.35% chromium, and the balance aluminum and incidental elements and impurities. For example, the ball-striking face 16 may comprise, by weight, at least 0.8% magnesium, at least 0.9% magnesium, at least 1.0% magnesium, or at least 1.1% magnesium. In further embodiments, the ball-striking face 16 may comprise, by weight, no more than 1.2% magnesium, no more than 1.1% magnesium, no more than 1.0% magnesium, or no more than 0.9% magnesium. In some embodiments, the ball-striking face 16 may comprise, by weight, at least 0.4% silicon, at least 0.5% silicon, at least 0.6% silicon, at least, or at least 0.7% silicon. In further embodiments, the ball-striking face 16 may comprise, by weight, no more than 0.8% silicon, no more than 0.7% silicon, no more than 0.6% silicon, or no more than 0.5% silicon. In some embodiments, the ball-striking face 16 may comprise, by weight, at least 0.15% copper, at least 0.20% copper, at least 0.25% copper, at least 0.30% copper, or at least 0.35% copper. In further embodiments, the ball-striking face 16 may comprise, by weight, no more than 0.40% copper, no more than 0.35% copper, no more than 0.30% copper, no more than 0.25% copper, or no more than 0.20% copper. In some embodiments, the ball-striking face 16 may comprise at least 0.04% chromium, at least 0.09% chromium, at least 0.14% chromium, at least 0.19% chromium, at least 0.24% chromium, at least 0.29% chromium, or at least 0.34% chromium. In further embodiments, the ball-striking face 16 may comprise no more than 0.35% chromium, no more than 0.30% chromium, no more than 0.25% chromium, no more than 0.20% chromium, no more than 0.15% chromium, no more than 0.10% chromium, or no more than 0.05% chromium. The apparatus, methods, and articles of manufacture described herein are not limited in this regard.

Figure 2:
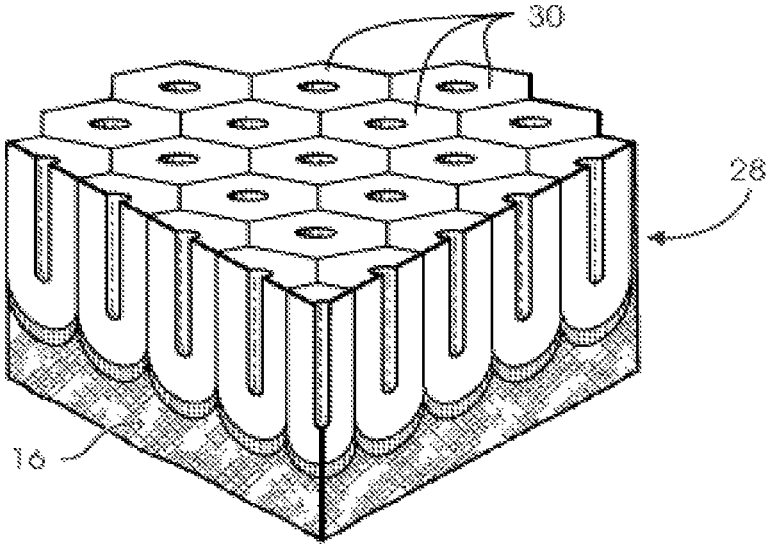
FIG. 2 is an enlarged partial perspective view of the ball-striking face of FIG. 1.

Referring to FIG. 2, the ball-striking face 16 is coupled to a protective ceramic layer 28. In some embodiments, the protective ceramic layer 28 may comprise at least one of an oxide, a carbide, a nitride, or any combination thereof. In further embodiments, the protective ceramic layer 28 may comprise at least one of aluminum oxide, titanium oxide, magnesium oxide, silicon dioxide, or any combination thereof. In the illustrated embodiment, the protective ceramic layer 28 may comprise a plurality of individually isolated cells 30 that include aluminum oxide ($Al_2O_3$). In some embodiments, the protective ceramic layer 28 may be substantially free of polymer or single-crystal aluminum oxide, also referred to as sapphire. In some embodiments, the protective ceramic layer 28 may give a substantially dark-colored or matte black appearance. Depending on the usage requirements or preferences for the particular golf club head 12, in other embodiments, the protective ceramic layer 28 may give a substantially gray-colored or green-colored appearance. Although FIG. 2 may depict the ball-striking face 16 being directly coupled to the protective ceramic layer 28, the ball-striking face 16 may be indirectly coupled to the protective ceramic layer 28 (e.g., an intermediate layer between the ball-striking face 16 and the protective ceramic layer 28). The apparatus, methods, and articles of manufacture described herein are not limited in this regard.

In some embodiments, the protective ceramic layer 28 may be associated with a thickness of at least 10 μm, at least 20 μm, at least 30 μm, at least 40 μm, at least 50 μm, at least 60 μm, at least 70 μm, at least 80 μm, at least 90 μm, at least 100 μm, at least 200 μm, at least 300 μm, at least 400 μm, at least 500 μm, at least 600 μm, at least 700 μm, at least 800 μm, at least 900 μm, at least 1.0 mm, at least 1.1 mm, at least 1.2 mm, at least 1.3 mm, at least 1.4 mm, at least 1.5 mm, at least 1.6 mm, at least 1.7 mm, at least 1.8 mm, or at least 1.9 mm. In further embodiments, the protective ceramic layer 28 may be associated with a thickness of no more than 2 mm, no more than 1.9 mm, no more than 1.8 mm, no more than 1.7 mm, no more than 1.6 mm, no more than 1.5 mm, no more than 1.4 mm, no more than 1.3 mm, no more than 1.2 mm, no more than 1.1 mm, no more than 1.0 mm, no more than 900 μm, no more than 800 μm, no more than 700 μm, no more than 600 μm, no more than 500 μm, no more than 400 μm, no more than 300 μm, no more than 200 μm, no more than 100 μm, no more than 90 μm, no more than 80 μm, no more than 70 μm, no more than 60 μm, no more than 50 μm, no more than 40 μm, no more than 30 μm, or no more than 20 μm. As such, the protective ceramic layer 28 may be associated with a thickness of 10 μm to 2 mm, 10 μm to 100 μm, or 20 μm to 2 mm. Depending on the usage requirements or preferences for the particular golf club head 12, a ceramic layer associated with a thickness of less than about 10 μm, e.g., produced through Type II anodizing, may not provide suitable protection against wear or denting.

According to one aspect, the protective ceramic layer 28 may be associated with a hardness that is greater than that of the ball-striking face 16. In some embodiments, the protective ceramic layer 28 may be associated with a hardness in Brinell scale (HB or BHN) of about 100 or more, 103 or more, 105 or more, 108 or more, 110 or more, 113 or more, 115 or more, 118 or more, or 120 or more. A Brinell hardness of about 111 corresponds to a Rockwell B-scale hardness (HRB) of about 65.7, and a Brinell hardness of about 121 corresponds to a HRB of about 69.8. While the Rockwell test is based on the difference in indentation depth from the imposition of minor and major loads, the Brinell hardness is determined from indentation size itself. In comparison, the ball-striking face 16 may be associated with a hardness of no more than 90, no more than 88, no more than 85, no more than 83, no more than 80, no more than 78, no more than 75, no more than 73, no more than 70, no more than 68, or no more than 65 in Brinell scale. The higher hardness of the protective ceramic layer 28 may enhance the wear resistance or dent resistance of the golf club head 12, all else being equal or held constant.

The higher hardness of the protective ceramic layer 28 may reduce a thickness of the ball-striking face 16 compared to other golf club heads. As described above, the reduced thickness of the ball-striking face 16 can reduce the weight of the golf club head 12 so that discretionary weight may be suitably placed elsewhere for enhancing the performance of the golf club 10. In some embodiments, the reduced weight in the golf club head 12 may be at least 1 gram, at least 2 grams, at least 3 grams, at least 4 grams, at least 5 grams, at least 6 grams, at least 7 grams, at least 8 grams, at least 9 grams, at least 10 grams, at least 11 grams, at least 12 grams, at least 13 grams, at least 14 grams, at least 15 grams, at least 16 grams, or at least 17 grams. In further embodiments, the reduced weight in the golf club head 12 may be no more than 18 grams, no more than 17 grams, no more than 16 grams, no more than 15 grams, no more than 14 grams, no more than 13 grams, no more than 12 grams, no more than 11 grams, no more than 10 grams, no more than 9 grams, no more than 8 grams, no more than 7 grams, no more than 6 grams, no more than 5 grams, no more than 4 grams, no more than 3 grams, or no more than 2 grams. As such, the reduced weight in the golf club head 12 may be 1 gram to 18 grams or 15 grams to 18 grams. The apparatus, methods, and articles of manufacture described herein are not limited in this regard.

The reduced weight may be suitably placed elsewhere for enhancing the performance of the golf club 10. In some embodiments, the reduced weight in the golf club head 12 may be redistributed by way of high-density inserts (not shown). For example, one or more tungsten inserts may be utilized to redistribute the reduced weight in the golf club head 12. In some embodiments, the tungsten inserts may be made of a mixture of tungsten particles and polyurethane resin. By adjusting the percentage of tungsten particles, the density of the tungsten insert may be adjusted. In some embodiments, the density of the tungsten inserts may be at least 5 g/cm$^3$, at least 6 g/cm$^3$, at least 7 g/cm$^3$, at least 8 g/cm$^3$, at least 9 g/cm$^3$, at least 10 g/cm$^3$, at least 20 g/cm$^3$, at least 30 g/cm$^3$, at least 40 g/cm$^3$, at least 50 g/cm$^3$, at least 60 g/cm$^3$, at least 70 g/cm$^3$, at least 80 g/cm$^3$, at least 90 g/cm$^3$, at least 100 g/cm$^3$, at least 200 g/cm$^3$, or at least 300 g/cm$^3$. In further embodiments, the density of the tungsten inserts may be no more than 300 g/cm$^3$, no more than 200 g/cm$^3$, no more than 100 g/cm$^3$, no more than 90 g/cm$^3$, no more than 80 g/cm$^3$, no more than 70 g/cm$^3$, no more than 60 g/cm$^3$, no more than 50 g/cm$^3$, no more than 40 g/cm$^3$, no more than 30 g/cm$^3$, no more than 20 g/cm$^3$, no more than 10 g/cm$^3$, no more than 9 g/cm$^3$, no more than 8 g/cm$^3$, no more than 7 g/cm$^3$, or no more than 6 g/cm$^3$. As such, the density of the tungsten inserts may be 5 g/cm$^3$ to 6 g/cm$^3$ or 5 g/cm$^3$ to 300 g/cm$^3$. In other embodiments, the redistributed weight may be integrally formed with the golf club head 12. The apparatus, methods, and articles of manufacture described herein are not limited in this regard.

Figure 3:
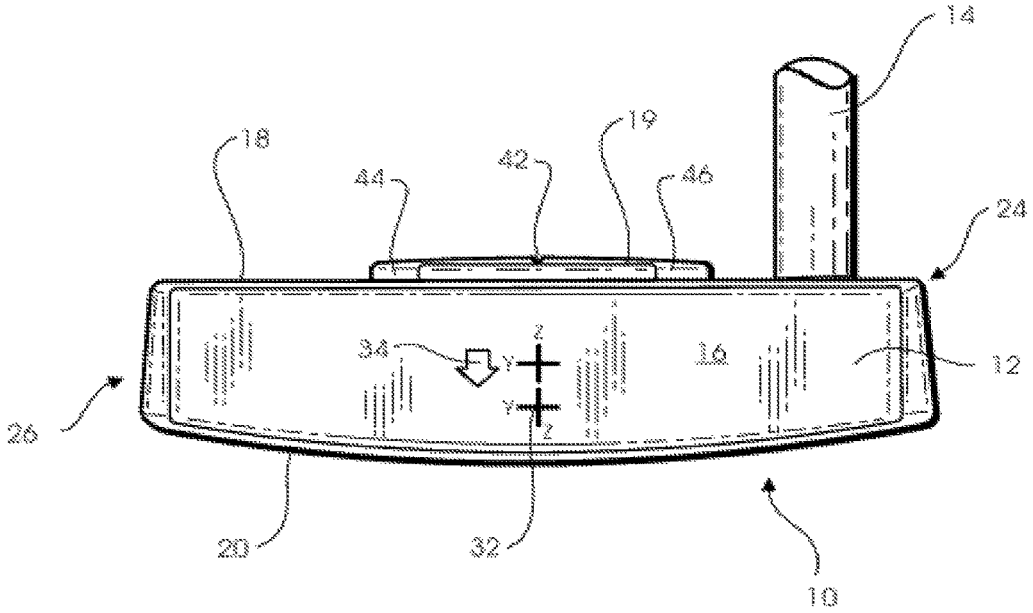
FIG. 3 is a front end view of the golf club head of FIG. 1.
Figure 4:
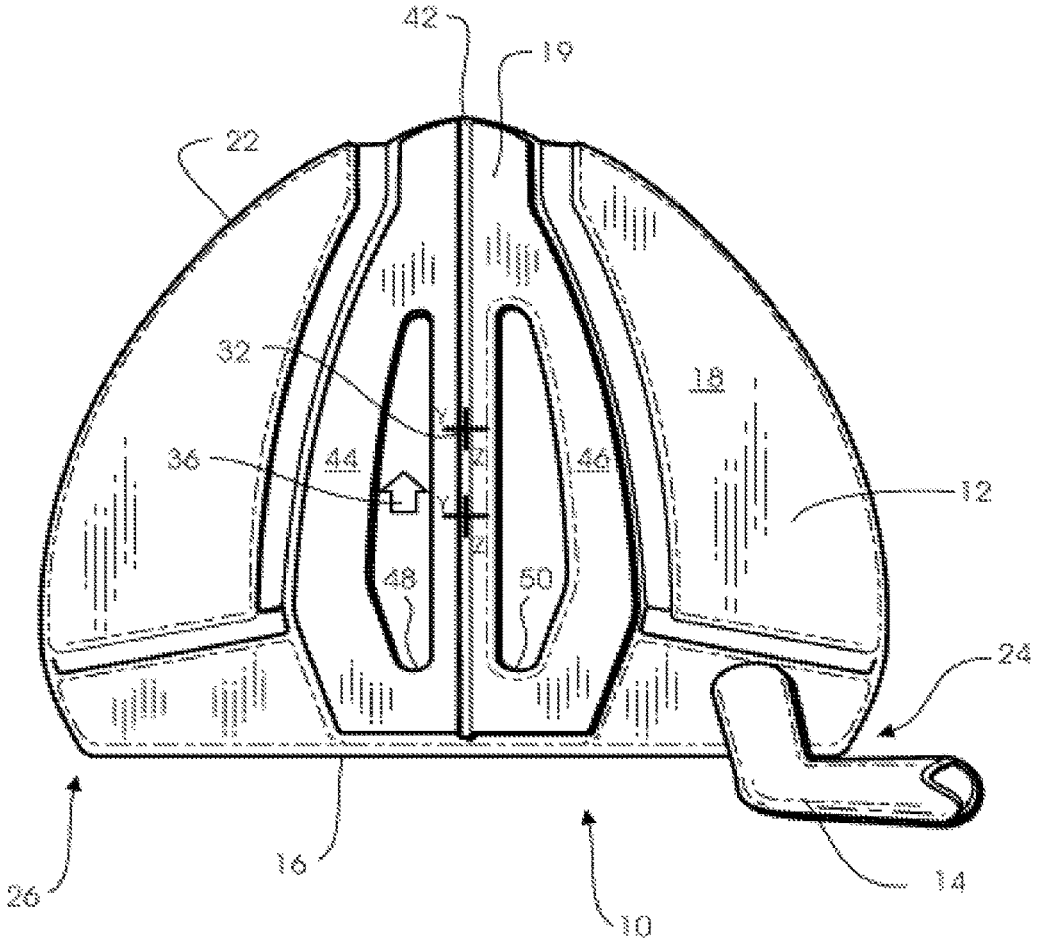
FIG. 4 is a plan view of the golf club head of FIG. 1.
Figure 5:
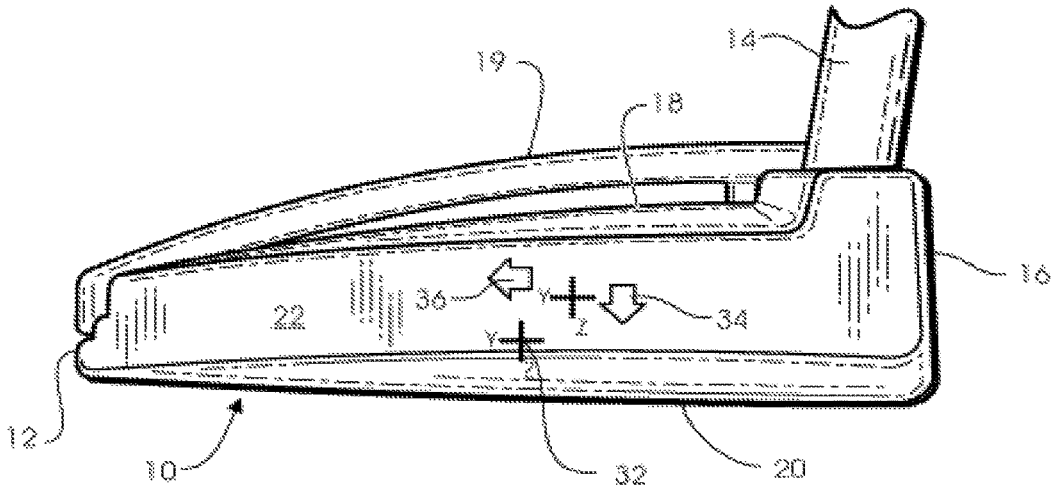
FIG. 5 is a left-side view of the golf club head of FIG. 1.
Figure 6:
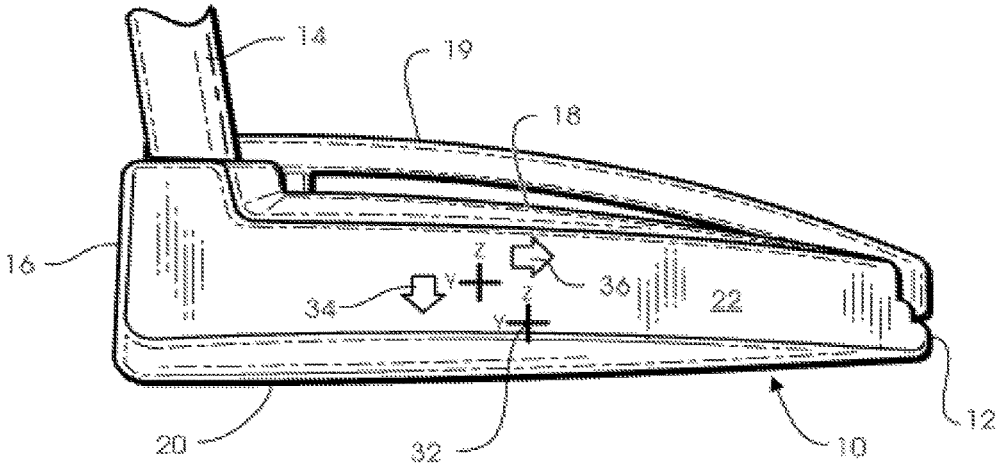
FIG. 6 is a right-side view of the golf club head of FIG. 1.

The redistributed weight may suitably enhance balance and stability of the golf club 10. Referring to FIG. 3, for example, a center of gravity (CG) 32 of the golf club head 12 may be advantageously lowered toward the bottom portion 20 of the golf club head 12 toward the direction 34, thereby improving the balance or stability of the golf club head 12. In some embodiments, the center of gravity 32 may be lowered by at least 0.1 mm, at least 0.2 mm, at least 0.3 mm, at least 0.4 mm, at least 0.5 mm, or at least 0.6 mm. Referring also to FIG. 4, the center of gravity 32 may be moved away from the ball-striking face 16 toward the direction 36, which may result in enhanced precision when an individual uses the golf club 10. Referring also to FIGS. 5 and 6, when viewed from the side, the center of gravity 32 may thus be advantageously moved away from the ball-striking face 16 and lowered toward the bottom portion 20 of the golf club head 12.

In some embodiments, the golf club head 12 may be associated with a moment of inertia about the center of gravity 32, ranging from about 800 g-cm$^2$ to about 4300 g-cm$^2$. A rotational moment of inertia may be a measure of the golf club head's resistance to angular acceleration, e.g., twisting or rotation, about a respective Cartesian reference axis (X axis, Y axis, or Z axis) of the golf club head 12.

The X axis extends from the toe 26 of the golf club head 12 through the center of gravity 32 and to the heel 24 of the golf club head 12. In some embodiments, the golf club head 12 may be associated with a moment of inertia about the center of gravity 32 about the X axis (Ixx), ranging from about 800 g-cm$^2$ to about 900 g-cm$^2$. In some embodiments, the golf club head 12 may be associated with an Ixx of at least 800 g-cm$^2$, at least 810 g-cm$^2$, at least 820 g-cm$^2$, at least 830 g-cm$^2$, at least 840 g-cm$^2$, at least 850 g-cm$^2$, at least 860 g-cm$^2$, at least 870 g-cm$^2$, at least 880 g-cm$^2$, or at least 890 g-cm$^2$. In further embodiments, the golf club head 12 may be associated with an Ixx of no more than 900 g-cm$^2$, no more than 890 g-cm$^2$, no more than 880 g-cm$^2$, no more than 870 g-cm$^2$, no more than 860 g-cm$^2$, no more than 850 g-cm$^2$, no more than 840 g-cm$^2$, no more than 830 g-cm$^2$, no more than 820 g-cm$^2$, or no more than 810 g-cm$^2$. The apparatus, methods, and articles of manufacture described herein are not limited in this regard.

In some embodiments, the golf club head 12 may be associated with a moment of inertia about the center of gravity 32 about the X axis (Ixx), ranging from about 1800 g-cm$^2$ to about 1900 g-cm$^2$. In some embodiments, the golf club head 12 may be associated with an Ixx of at least 1800 g-cm$^2$, at least 1810 g-cm$^2$, at least 1820 g-cm$^2$, at least 1830 g-cm$^2$, at least 1840 g-cm$^2$, at least 1850 g-cm$^2$, at least 1860 g-cm$^2$, at least 1870 g-cm$^2$, at least 1880 g-cm$^2$, or at least 1890 g-cm$^2$. In further embodiments, the golf club head 12 may be associated with an Ixx of no more than 1900 g-cm$^2$, no more than 1890 g-cm$^2$, no more than 1880 g-cm$^2$, no more than 1870 g-cm$^2$, no more than 1860 g-cm$^2$, no more than 1850 g-cm$^2$, no more than 1840 g-cm$^2$, no more than 1830 g-cm$^2$, no more than 1820 g-cm$^2$, or no more than 1810 g-cm$^2$. The apparatus, methods, and articles of manufacture described herein are not limited in this regard.

The Y axis extends from the ball-striking face 16 through the center of gravity 32 and to the rear of the golf club head 12. In some embodiments, the golf club head 12 may be associated with a moment of inertia about the center of gravity 32 about the Y axis (Iyy), ranging from about 1800 g-cm$^2$ to about 2000 g-cm$^2$. In some embodiments, the golf club head 12 may be associated with an Iyy of at least 1800 g-cm$^2$, at least 1820 g-cm$^2$, at least 1840 g-cm$^2$, at least 1860 g-cm$^2$, at least 1880 g-cm$^2$, at least 1900 g-cm$^2$, at least 1920 g-cm$^2$, at least 1940 g-cm$^2$, at least 1960 g-cm$^2$, or at least 1980 g-cm$^2$. In further embodiments, the golf club head 12 may be associated with an Iyy of no more than 2000 g-cm$^2$, no more than 1980 g-cm$^2$, no more than 1960 g-cm$^2$, no more than 1940 g-cm$^2$, no more than 1920 g-cm$^2$, no more than 1900 g-cm$^2$, no more than 1880 g-cm$^2$, no more than 1860 g-cm$^2$, no more than 1840 g-cm$^2$, or no more than 1820 g-cm$^2$. The apparatus, methods, and articles of manufacture described herein are not limited in this regard.

In some embodiments, the golf club head 12 may be associated with a moment of inertia about the center of gravity 32 about the Y axis (Iyy), ranging from about 4100 g-cm$^2$ to about 4300 g-cm$^2$. In some embodiments, the golf club head 12 may be associated with an Iyy of at least 4100 g-cm$^2$, at least 4120 g-cm$^2$, at least 4140 g-cm$^2$, at least 4160 g-cm$^2$, at least 4180 g-cm$^2$, at least 4200 g-cm$^2$, at least 4220 g-cm$^2$, at least 4240 g-cm$^2$, at least 4260 g-cm$^2$, or at least 4280 g-cm$^2$. In further embodiments, the golf club head 12 may be associated with an Iyy of no more than 4300 g-cm$^2$, no more than 4280 g-cm$^2$, no more than 4260 g-cm$^2$, no more than 4240 g-cm$^2$, no more than 4220 g-cm$^2$, no more than 4200 g-cm$^2$, no more than 4180 g-cm$^2$, no more than 4160 g-cm$^2$, no more than 4140 g-cm$^2$, or no more than 4120 g-cm$^2$. The apparatus, methods, and articles of manufacture described herein are not limited in this regard.

The Z axis extends from the top portion 18 through the center of gravity 32 and to the bottom portion 20. In some embodiments, the golf club head 12 may be associated with a moment of inertia about the center of gravity 32 about the Z axis (Izz), ranging from about 1100 g-cm$^2$ to about 1200 g-cm$^2$. In some embodiments, the golf club head 12 may be associated with an Izz of at least 1100 g-cm$^2$, at least 1110 g-cm$^2$, at least 1120 g-cm$^2$, at least 1130 g-cm$^2$, at least 1140 g-cm$^2$, at least 1150 g-cm$^2$, at least 1160 g-cm$^2$, at least 1170 g-cm$^2$, at least 1180 g-cm$^2$, or at least 1190 g-cm$^2$. In further embodiments, the golf club head 12 may be associated with an Izz of no more than 1200 g-cm$^2$, no more than 1190 g-cm$^2$, no more than 1180 g-cm$^2$, no more than 1170 g-cm$^2$, no more than 1160 g-cm$^2$, no more than 1150 g-cm$^2$, no more than 1140 g-cm$^2$, no more than 1130 g-cm$^2$, no more than 1120 g-cm$^2$, or no more than 1110 g-cm$^2$. The apparatus, methods, and articles of manufacture described herein are not limited in this regard.

In some embodiments, the golf club head 12 may be associated with a moment of inertia about the center of gravity 32 about the Z axis (Izz), ranging from about 2500 g-cm$^2$ to about 2700 g-cm$^2$. In some embodiments, the golf club head 12 may be associated with an Izz of at least 2500 g-cm$^2$, at least 2520 g-cm$^2$, at least 2540 g-cm$^2$, at least 2560 g-cm$^2$, at least 2580 g-cm$^2$, at least 2600 g-cm$^2$, at least 2620 g-cm$^2$, at least 2640 g-cm$^2$, at least 2660 g-cm$^2$, or at least 2680 g-cm$^2$. In further embodiments, the golf club head 12 may be associated with an Izz of no more than 2700 g-cm$^2$, no more than 2680 g-cm$^2$, no more than 2660 g-cm$^2$, no more than 2640 g-cm$^2$, no more than 2620 g-cm$^2$, no more than 2600 g-cm$^2$, no more than 2580 g-cm$^2$, no more than 2560 g-cm$^2$, no more than 2540 g-cm$^2$, or no more than 2520 g-cm$^2$. The apparatus, methods, and articles of manufacture described herein are not limited in this regard.

Figure 7:
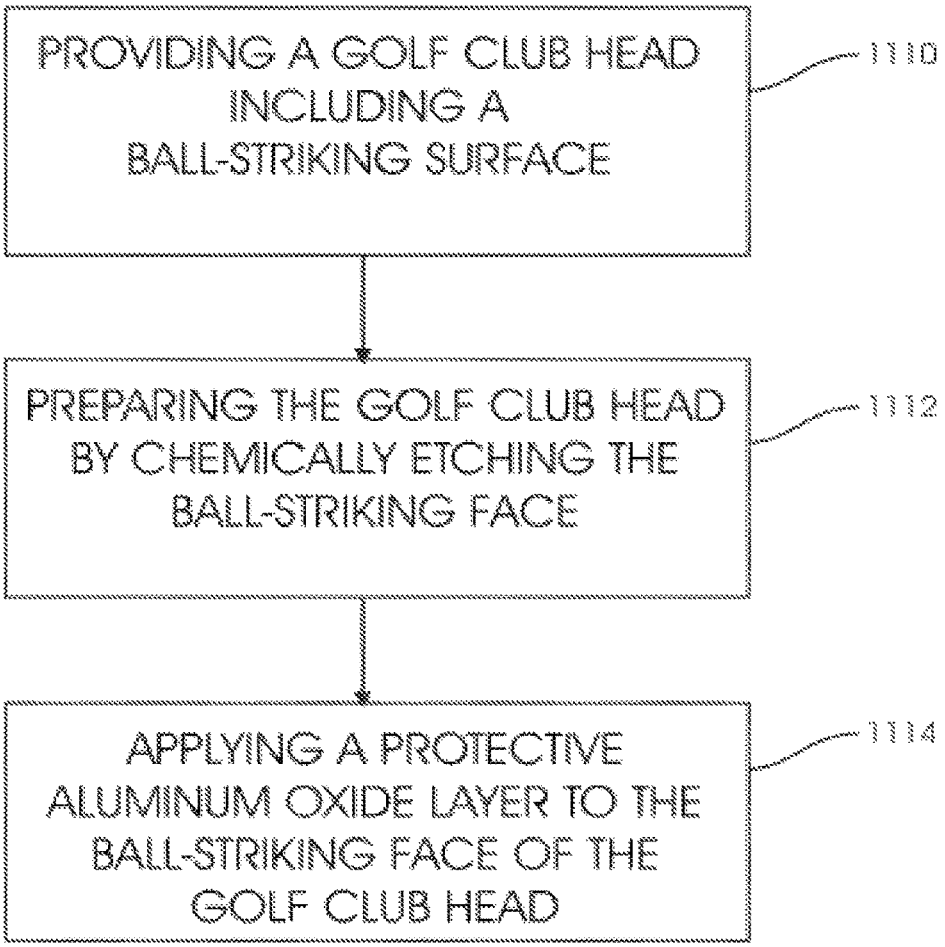
FIG. 7 is a flow chart illustrating a method for manufacturing the golf club head of FIG. 1.

According to one aspect, a method of making the golf club head 12 generally includes providing the golf club head 12 including a ball-striking face 16, and applying the protective ceramic layer 28 to the ball-striking face 16 of the golf club head 12. In the example of FIG. 7, a process 1100 may begin with providing the golf club head 12 including a ball-striking face 16 (block 1110). At block 1112, the golf club head 12 may be prepared by chemically etching the ball-striking face 16. At block 1114, the protective ceramic layer 28 is applied to the ball-striking face 16. In some embodiments, the protective ceramic layer 28 may be applied by anodizing, plating, painting, cladding, laser cladding, laser surface alloying, or any combination thereof.

The protective ceramic layer 28 may be preferably applied by anodizing. As used herein, anodizing refers to a surface treatment in an acidic electrolyte to provide an aluminum oxide. In some embodiments, the electrolyte may include at least one of a sulfuric acid ($H_2SO_4$) and a chromic acid. In process, the ball-striking face 16 may be immersed in the acid bath and serve as an anode in an electrolytic cell, while the acid bath may serve as the cathode. In some embodiments, the protective ceramic layer 28 applied by anodizing may adhere better to the underlying ball-striking face 16, compared to those produced by other processes, as may be confirmed by a tape test.

In some embodiments, the protective ceramic layer 28 may be applied at a temperature of at least 0° C., at least 1° C., at least 2° C., or at least 3° C. In further embodiments, the protective ceramic layer 28 may be applied at a temperature of no more than 4° C., no more than 3° C., no more than 2° C., or no more than 1° C. As such, the protective ceramic layer 28 may be applied at a temperature of 0° C. to 4° C. In some embodiments, the duration of the anodizing process may be at least 45 minutes, at least 46 minutes, at least 47 minutes, at least 48 minutes, at least 49 minutes, at least 50 minutes, at least 51 minutes, at least 52 minutes, at least 53 minutes, at least 54 minutes, at least 55 minutes, at least 56 minutes, at least 57 minutes, at least 58 minutes, or at least 59 minutes. In further embodiments, the duration of the anodizing process may be no more than 60 minutes, no more than 59 minutes, no more than 58 minutes, no more than 57 minutes, no more than 56 minutes, no more than 55 minutes, no more than 54 minutes, no more than 53 minutes, no more than 52 minutes, no more than 51 minutes, no more than 50 minutes, no more than 49 minutes, no more than 48 minutes, no more than 47 minutes, or no more than 46 minutes. As such, the duration of the anodizing process may be 45 minutes to 60 minutes.

While a particular order of actions is illustrated in FIG. 7, these actions may be performed in other temporal sequences. For example, the actions depicted in FIG. 7 may be performed sequentially, concurrently, or simultaneously. Alternatively, the actions depicted may be performed in reversed order. Further, one or more actions depicted in FIG. 7 may not be performed at all.

Figure 8:
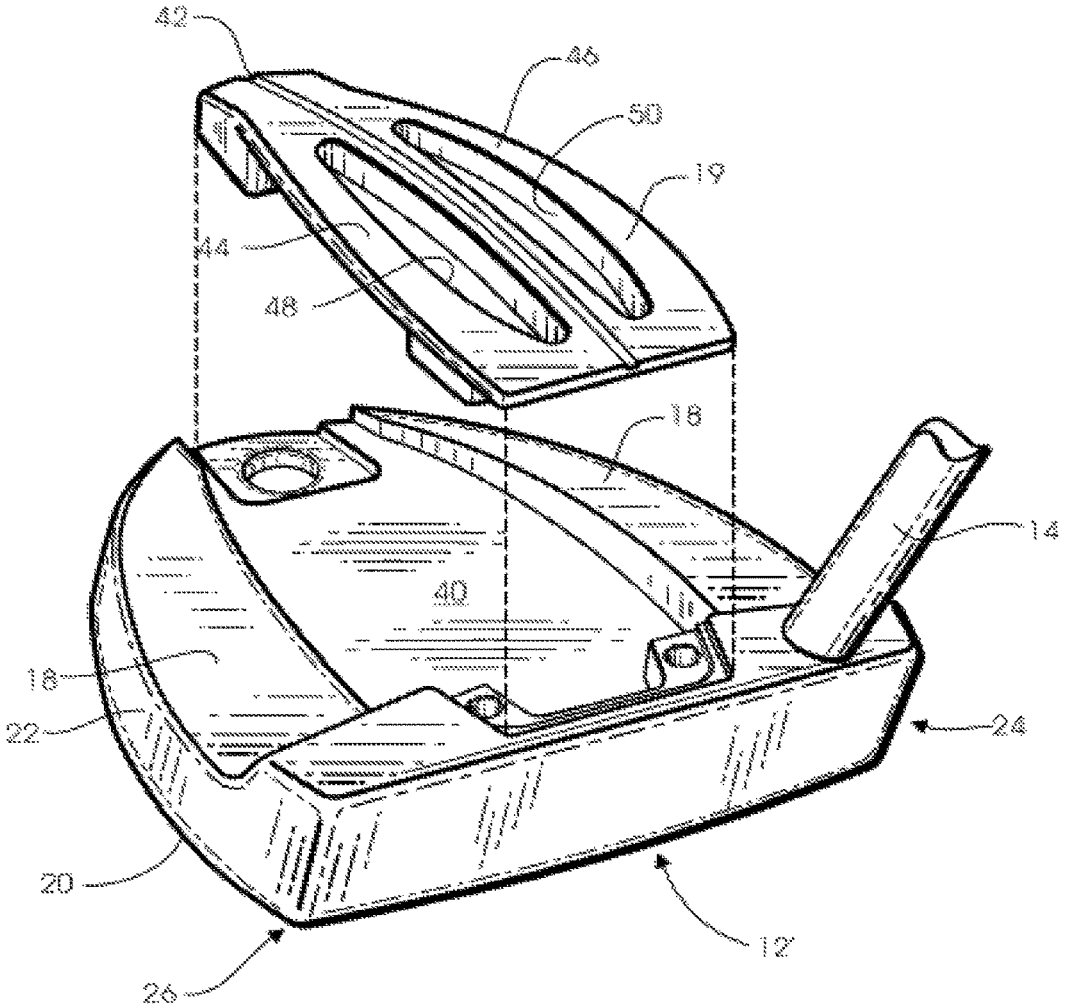
FIG. 8 is an exploded perspective view of a golf club head according to another embodiment.

FIG. 8 illustrates the golf club head 12 according to another embodiment. This embodiment employs much of the same structure and has many of the same properties as the embodiment of the golf club head 12 described above in connection with FIGS. 1-7. Accordingly, the following description focuses primarily upon the structure and features that are different than the embodiment described above in connection with FIGS. 1-7. Reference should be made to the description above in connection with FIGS. 1-7 for additional information regarding the structure and features, and possible alternatives to the structure and features of the golf club head 12' illustrated in FIG. 8 and described below. Structure and features of the embodiment shown in FIG. 8 that correspond to structure and features of the embodiment of FIGS. 1-7 are designated hereinafter with like reference numbers.

In this embodiment, the golf club head 12' includes an attachment mechanism 40 for the interchangeable alignment indicia 19. Referring to FIG. 8, in the illustrated embodiment the attachment mechanism 40 is a cavity or recess. In other embodiments, however, the attachment mechanism 40 may be a protrusion or other structure that can fittingly or seamlessly receive the interchangeable alignment indicia 19.

The illustrated golf club head 12' is coupled to one of a plurality of interchangeable alignment indicia 19 that includes a center line 42 positioned between two outer lines 44, 46 that together form a roughly lenticular shape. That is, the outer lines 44, 46 are each associated with a convex curvature and enclose a cavity, which is split by the center line 42 into two halves 48, 50. In further embodiments, the interchangeable alignment indicia 19 may include one or more raised, stepped, or other three-dimensional profiles of varying numbers, thicknesses, or heights. Moreover, the interchangeable alignment indicia 19 may include various colors or finishes. For example, the interchangeable alignment indicia 19 may include various shades of white, pink, red, orange, yellow, green, blue, violet, black, grey, etc. In other embodiments, the interchangeable alignment indicia 19 may include any configuration so long as the alignment indicia 19 can guide the golf club head 12' relative to a golf ball (not shown) and the alignment indicia 19 can fit the golf club head 12'. For example, the interchangeable alignment indicia 19 may assume any geometric form in cross section, including, but not limited to, a rectangular, a triangular, an ellipsoidal, a regular polyhedral, and an irregular polyhedral shape, derivatives thereof, and combinations thereof.

In some embodiments, the interchangeable alignment indicia 19 may be formed of a suitable plastic material. It may be advantageous to form the interchangeable alignment indicia 19 of a plastic material because plastic can be cheap, and further because plastic can be light, thus not significantly raising a center of gravity of the golf club head 12'. In other embodiments, however, the interchangeable alignment indicia 19 may be formed of any other suitable materials, including, but not limited to, aluminum, titanium, or carbon fiber.

The interchangeable alignment indicia 19 can allow (1) a manufacturer, (2) an individual, or (3) both a manufacturer and an individual, to choose from or customize based on a variety of options to potentially improve alignment relative to a golf ball. In the first case, the interchangeability of the alignment indicia 19 gives a manufacturer the ability to stock one golf club head 12' and a variety of alignment indicia 19 separately, instead of a variety of golf club head 12' with various alignment indicia 19 attached thereto. Therefore, less parts are required to be in inventory for providing a customized golf club head 12' to a consumer. In some embodiments, the interchangeable alignment indicia 19' may be so dimensioned as to fit the attachment mechanism 40 of multiple golf club heads 12', thereby allowing a large number of combinations for the interchangeable alignment indicia 19' and golf club heads 12' without significantly increasing the number of parts in inventory.

In the second case, an individual may not know his or her preference for the alignment index 19, or the preference may change during use of the golf club head 12', e.g., depending on the game conditions. The interchangeability of the alignment indicia 19 gives the individual the freedom and ability to try a different alignment index 19 from time to time as desired, so as to potentially improve the alignment relative to a golf ball or boost the individual's confidence. In some embodiments, the individual may even be allowed to design his or her own alignment index 19.

In the third case, the interchangeability of the alignment indicia 19 gives a manufacturer the ability to stock one golf club head 12' and a variety of alignment indicia 19 separately, and an individual can further choose from or customize based on a variety of interchangeable options. For example, the manufacturer can sell the golf club head 12' and the alignment indicia 19 separately, and the individual or consumer can change the alignment indicia 19 whenever his or her preference or game conditions change.

An illustrative embodiment of the golf club head 12 is described in greater detail below.

EXAMPLE

A putter head made out of the 6061 aluminum alloy was anodized at Noranco Inc. (JET Processing Division) in Phoenix, Ariz. The hardness was measured in both Rockwell B-scale (HRB) and Brinell scale for the coated and uncoated putter head, as summarized in the following Table 1.

TABLE 1

| | HRB | Brinell |
|---|---|---|
| Uncoated putter head | 51.8 | 90 |
| Coated putter head | 62.3 | 105 |

The position of the center of gravity relative to the Z axis and moments of inertia about respective Cartesian reference axes were calculated, as summarized in the following Table 2.

TABLE 2

| | Ixx ($g\text{-}cm^2$) | Iyy ($g\text{-}cm^2$) | Izz ($g\text{-}cm^2$) | CG position - z (cm) |
|---|---|---|---|---|
| Uncoated putter head | 1883.9 | 4180.6 | 2580.6 | 1.09 |
| Coated putter head | 1845.2 | 4193.5 | 2625.8 | 1.03 |

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

What is claimed is:

1. A golf club head comprising a ball-striking face, wherein the ball-striking face is associated with a first hardness; and a protective aluminum oxide layer coupled to the ball-striking face, wherein the protective aluminum oxide layer is associated with a second hardness, and wherein the second hardness is greater than the first hardness;

the ball-striking face comprises, by weight, about 0.15% to about 0.40% copper, about 0.04% to about 0.35% chromium, and balance aluminum;

the second hardness is about 105 in Brinell scale; and wherein a thickness of the ball-striking face is reduced in order to reduce weight of the ball-striking face by no more than 18 grams compared to a ball-striking face without a protective aluminum oxide layer, wherein the no more than 18 grams of weight is redistributed to move a center of gravity of the golf club head away from the ball-striking face and lower the center of gravity toward a bottom portion of the golf club head by at least 0.1 millimeter (mm).

2. The golf club head of claim 1, wherein:

the golf club head is associated with a moment of inertia about a Y axis of the golf club head, the moment of inertia ranging from about 4100 $g\text{-}cm^2$ to about 4300 $g\text{-}cm^2$;

the golf club head is associated with a moment of inertia about an X axis of the golf club head, the moment of inertia ranging from about 800 $g\text{-}cm^2$ to about 900 $g\text{-}cm^2$; and the golf club head is associated with a moment of inertia about a Z axis of the golf club head, the moment of inertia ranging from about 1100 $g\text{-}cm^2$ to about 1200 $g\text{-}cm^2$.

3. The golf club head of claim 1, wherein the protective aluminum oxide layer is associated with a thickness of about 10 microns (μm) to about 2 millimeters (mm).

4. The golf club of claim 1, wherein the ball-striking face further comprises, by weight, at least 0.8% magnesium, and at least 0.4% silicon.

5. The golf club head of claim 1 further comprising a top portion, at least one of a plurality of interchangeable alignment indicia coupled to the top portion, the interchangeable alignment indicia being configured to guide the golf club head relative to a golf ball, and an attachment mechanism configured to receive the interchangeable alignment indicia.

6. A method of coating a golf club head, comprising:

providing a golf club head including a ball-striking face, wherein the ball-striking face is associated with a first hardness;

applying a protective ceramic layer to the ball-striking face, wherein the protective ceramic layer is associated with a second hardness, and wherein the second hardness is greater than the first hardness;

wherein the ball-striking face comprises, by weight, about 0.15% to about 0.40% copper, about 0.04% to about 0.35% chromium, and balance aluminum;

the second hardness is about 105 in Brinell scale; and wherein a thickness of the ball-striking face is reduced in order to reduce weight of the ball-striking face by no more than 18 grams compared to a ball-striking face without a protective aluminum oxide layer, wherein the no more than 18 grams of weight is redistributed to move a center of gravity of the golf club head away from the ball-striking face and lower the center of gravity toward the bottom portion of the golf club head by at least 0.1 millimeter (mm).

7. The method of claim 6, wherein the protective ceramic layer is associated with a thickness of about 10 microns (μm) to about 2 millimeters (mm).

8. The method of claim 6, wherein applying the protective ceramic layer to the ball-striking face comprises applying a protective ceramic layer by at least one of anodizing the protective ceramic layer, plating the protective ceramic layer, painting protective ceramic layer, cladding the protective ceramic layer, laser cladding protective ceramic layer, and laser surface alloying the protective ceramic layer.

9. The method of claim 6, wherein applying a protective ceramic layer to the ball-striking face of the golf club head comprises applying a protective ceramic layer by anodizing in an electrolyte, and wherein the electrolyte comprises at least one of a sulfuric acid and a chromic acid.

10. The method of claim 6, wherein the protective ceramic layer comprises at least one of an oxide, a carbide, and a nitride.

11. The method of claim 6, wherein the protective ceramic layer comprises at least one of aluminum oxide, titanium oxide, magnesium oxide, and silicon dioxide.

12. The method of claim 6, wherein the ball-striking face further comprises, by weight, at least 0.8% magnesium, and at least 0.4% silicon.

13. The method of claim 6, wherein the ball-striking face further comprises at least one of an aluminum alloy, a stainless steel, a carbon steel, a titanium alloy, a copper alloy, a nickel alloy, a magnesium alloy, an amorphous alloy, and a composite material.

14. The method of claim 6 further comprising preparing the golf club head by chemically etching the ball-striking face.

15. The method of claim 6, wherein the second hardness is about 100 or more in Brinell scale.

16. The method of claim 6, wherein applying a protective ceramic layer to the ball-striking face of the golf club head comprises applying a protective ceramic layer at a temperature of about 0° C. to about 4° C.

17. A golf club comprising:

a shaft;

a golf club head coupled to the shaft, wherein the golf club head having a ball-striking face associated with a first hardness;

a protective aluminum oxide layer coupled to the ball-striking face, wherein the protective aluminum oxide layer is associated with a second hardness, and wherein the second hardness is greater than the first hardness;

the ball-striking face comprises, by weight, about 0.15% to about 0.40% copper, about 0.04% to about 0.35% chromium, and balance aluminum;

the second hardness is about 105 in Brinell scale; and wherein a thickness of the ball-striking face is reduced in order to reduce weight of the ball-striking face by no more than 18 grams compared to a ball-striking face without a protective aluminum oxide layer, wherein the no more than 18 grams of weight is redistributed to move a center of gravity of the golf club head away from the ball-striking face and lower the center of gravity toward a bottom portion of the golf club head by at least 0.1 millimeter (mm).

18. The golf club of claim 17, wherein:

the golf club head is associated with a moment of inertia about a Y axis of the golf club head, the moment of inertia ranging from about 4100 g-cm$^2$ to about 4300 g-cm$^2$;

the golf club head is associated with a moment of inertia about an X axis of the golf club head, the moment of inertia ranging from about 800 g-cm$^2$ to about 900 g-cm$^2$; and the golf club head is associated with a moment of inertia about a Z axis of the club head, the moment of inertia ranging from about 1100 g-cm$^2$ to about 1200 g-cm$^2$.

19. The golf club of claim 17, wherein the ball-striking face further comprises, by weight, at least 0.8% magnesium, and at least 0.4% silicon.

20. The golf club of claim 17, wherein the golf club further comprises a top portion, at least one of a plurality of interchangeable alignment indicia coupled to the top portion, the interchangeable alignment indicia being configured to guide the golf club head relative to a golf ball, and an attachment mechanism configured to receive the interchangeable alignment indicia.

* * * * *